US011919064B1

(12) United States Patent
Donney et al.

(10) Patent No.: US 11,919,064 B1
(45) Date of Patent: Mar. 5, 2024

(54) APPARATUS FOR DISASSEMBLING PRESSED TOGETHER CRANKSHAFTS

(71) Applicants: Tom J. Donney, Sturgis, SD (US); David A Roe, Fort Dodge, CA (US)

(72) Inventors: Tom J. Donney, Sturgis, SD (US); David A Roe, Fort Dodge, CA (US)

(73) Assignee: Tom J. Donney, Sturgis, SD (US)

( * ) Notice: Subject to any disclaimer, the term of this patent is extended or adjusted under 35 U.S.C. 154(b) by 0 days.

(21) Appl. No.: 18/119,097

(22) Filed: Mar. 8, 2023

(51) Int. Cl.
*B21D 53/84* (2006.01)

(52) U.S. Cl.
CPC ..... *B21D 53/845* (2013.01)

(58) Field of Classification Search
CPC ..... B21D 53/845
See application file for complete search history.

(56) References Cited

U.S. PATENT DOCUMENTS

2017/0312804 A1* 11/2017 Lindner ..... F01L 1/053

* cited by examiner

*Primary Examiner* — Moshe Wilensky
(74) *Attorney, Agent, or Firm* — Watts Law, LLC; John A. Yirga

(57) ABSTRACT

Apparatus for facilitating the disassembly and assembly of a pressed-together crankshaft such as found on a two-stroke engine used in automobiles, motor boats, wave runners, etc. The apparatus includes a crankshaft engagement member rotatably connected to a channel member which includes a fixed abutment plate, a channel having a pair of flanges interconnected by a web portion which is bent outwardly to provide clearance for at least a portion of a crankshaft assembly engaged by the crankshaft engagement member. The engagement member includes a slot for receiving and supporting a crankshaft throw while a pin forming part of the throw is pressed from its operative position. The engagement member includes a second slot for receiving a center portion of the crankshaft assembly while a center shaft member is pressed from its operative position to allow the removal of a crankshaft center support bearing. The crankshaft engagement member may include a third slot for receiving a center portion of a crankshaft assembly having a different configuration. The crankshaft engagement member is rotatable in order to position a selected slot in its operative position. The crankshaft engagement member is replaceable with the engagement member configured to receive a predetermined crankshaft assembly.

13 Claims, 14 Drawing Sheets

APPARATUS FOR DISASSEMBLING PRESSED TOGETHER CRANKSHAFTS

TECHNICAL FIELD

The present invention relates generally to the repair of engine crankshafts and, in particular, to the repair of engine crankshafts that comprise machined components that are pressed together to form a crankshaft assembly that is supported for rotation in an engine block by annular ball or roller bearings.

BACKGROUND

Pressed together crankshaft assemblies to which this invention pertains are used in engine applications in which the crankshaft is supported for rotation within an engine block by annular ball and/or roller bearings. These types of engines typically do not include an oil sump or a means for circulating oil from the oil sump to other parts of the engine. An example of this type of engine is a two-stroke (2 stroke) IC combustion engine that was used in Saab automobiles in the 1950's and early 1960's. These types of engines or motors
are currently used to power certain boats, snowmobiles, and watercraft such as wave runners. These types of engines typically include annular bearings such as needle bearings that are located between the piston connecting rod and a crankshaft throw. It should be apparent, that if an annular crankshaft bearing or a rod bearing needs replacement, a pressed together crankshaft must be separated to replace the bearings and then reassembled after bearing replacement.

SUMMARY OF THE INVENTION

The present invention provides a tool or fixture which facilitates the disassembly and reassembly of a pressed-together crankshaft in order to replace annular crankshaft bearings and/or annular connecting rod bearings.

In the preferred and illustrated embodiment, the apparatus comprises a tool or fixture that includes a crankshaft assembly engagement member having a first slot for receiving and supporting a crankshaft throw portion while a rod pin is pressed out of its associated throw member. The crankshaft assembly engagement member further includes a second slot for engaging and supporting a center section of the crankshaft assembly which permits a crankshaft center member to be pressed from an associated throw member whereby a center support bearing can be removed from the crankshaft assembly. The crankshaft engagement member is rotatably attached to a fixed support plate which is fixedly attached to a channel member. The channel member is also attached to a base plate which, in the preferred embodiment, supports the channel and in a vertical orientation. The channel includes a pair of spaced flanges joined together by a web. In the disclosed construction, when a crankshaft assembly is engaged by the engagement member, a portion of the crankshaft assembly hangs in a recess defined by a web portion and the flange members.

In a more preferred embodiment, the web portion is bent outwardly with respect to the flanges to provide increased space for receiving the crankshaft assembly portion hanging below the crankshaft engagement member. According to a feature of the invention, the crankshaft engagement member is rotatable with respect to the fixed support plate so that the first and second slots can be positioned in an operative position by simply rotating the crankshaft engagement member. In the preferred and illustrated embodiment, the first and second slots are spaced apart by substantially 90°.

According to the preferred and illustrated embodiment, the crankshaft engagement plate includes a third slot for receiving a crankshaft throw portion having a different configuration from the crankshaft throw portion that is engageable by the first slot. In the illustrated embodiment, the third slot is spaced substantially 90° with respect to one of the other slots and is moved into its operative position by rotation of the crankshaft engagement member.

In a more preferred embodiment, the first slot has a reduced thickness so that the slot can receive a throw member with reduced clearance.

As should be apparent, the present invention provides a compact tool or fixture which enables a pressed-together crankshaft to be disassembled to replace annular crankshaft and connecting rod bearings. The disclosed apparatus also facilitates the pressing together of the crankshaft components after the annular bearings and/or other annular components are replaced.

Additional features of the invention will become apparent and a fuller understanding obtained by reading the following detailed description in connection with the accompanying drawings.

DETAILED DESCRIPTION

Figure 1:
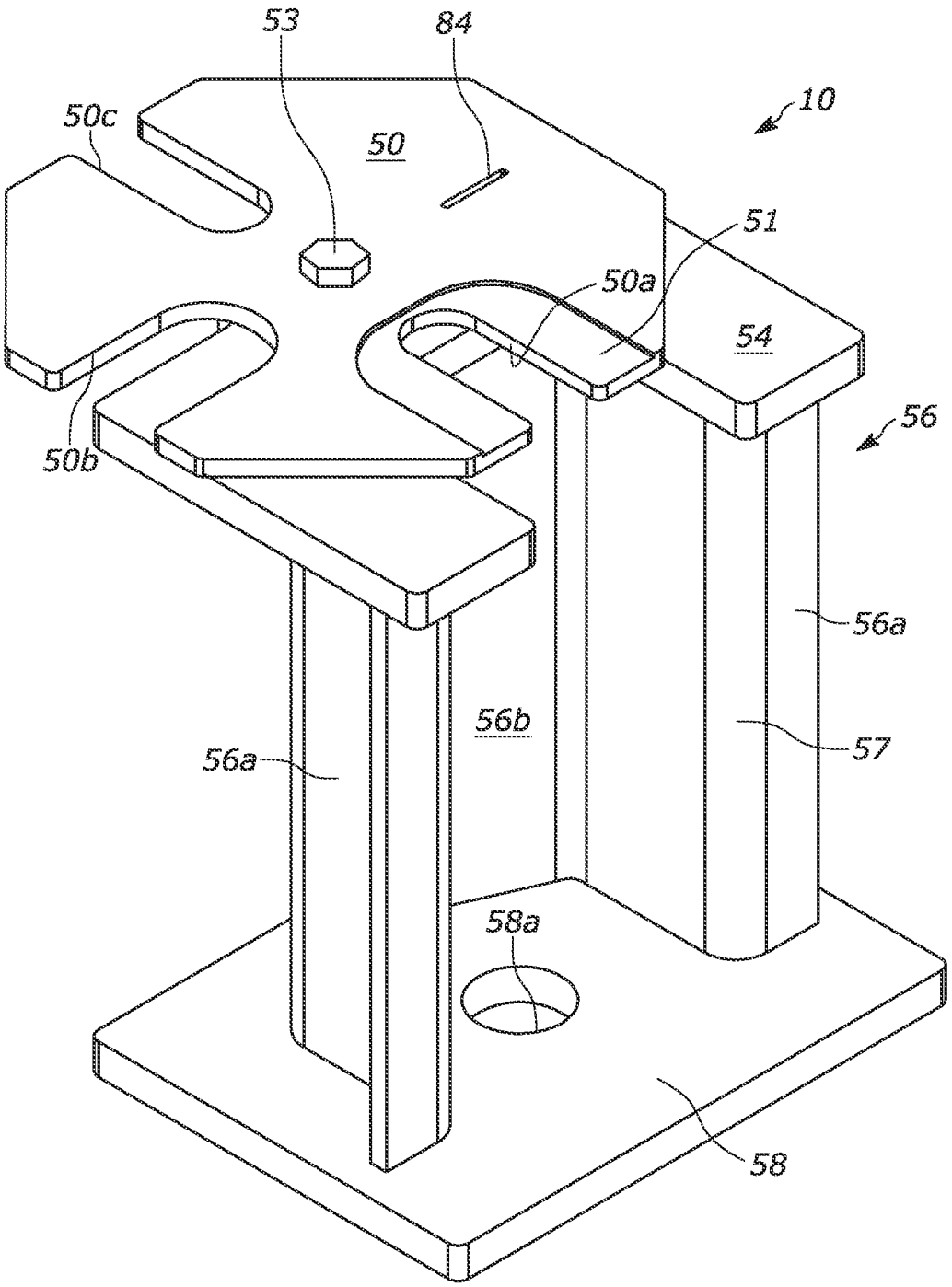
FIG. 1 is a perspective view of a crankshaft repair apparatus or fixture for disassembling and reassembling a pressed-together crankshaft.
Figure 2A:
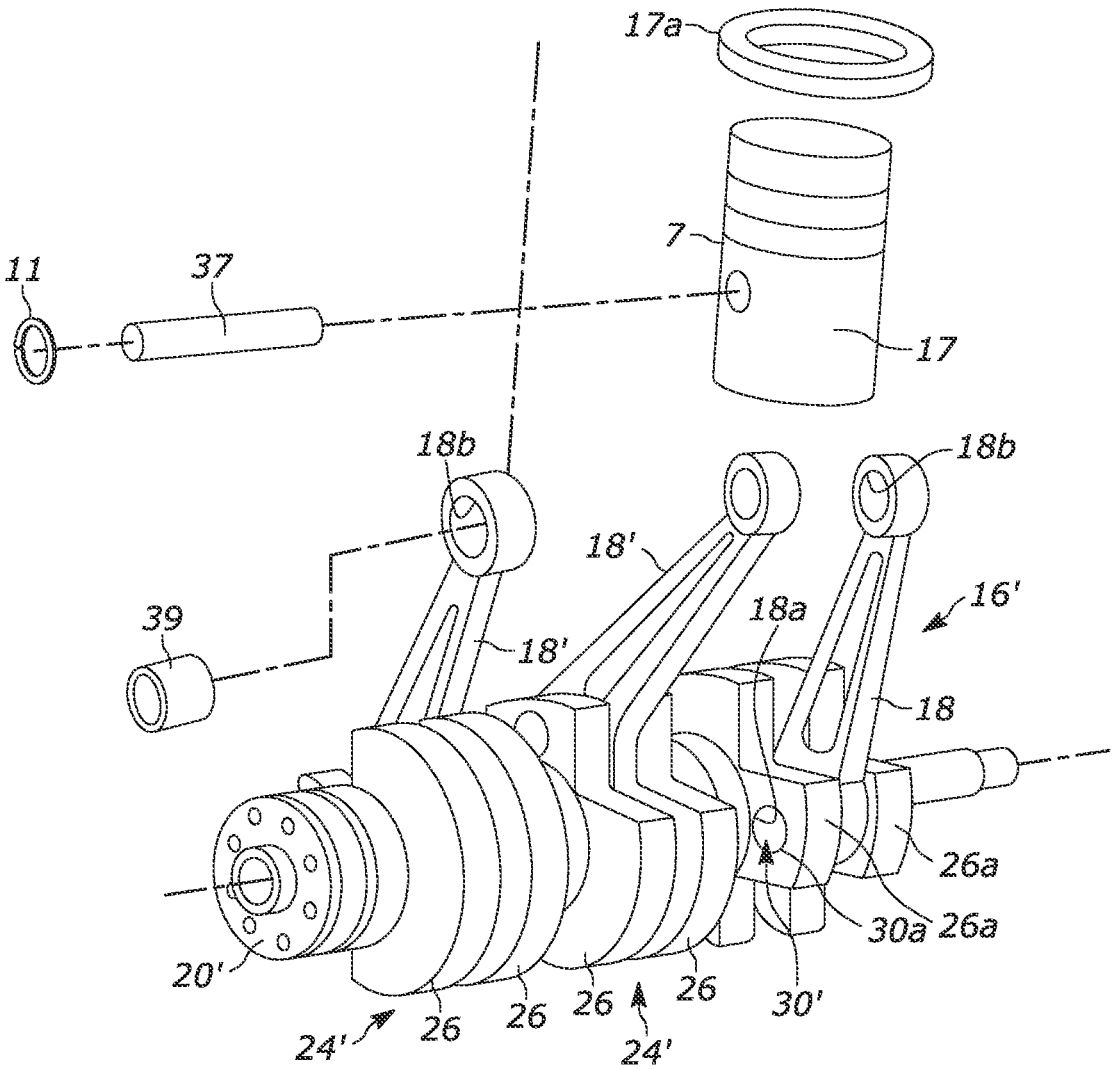
FIG. 2A is a perspective view of an example of pressed together crankshaft assembly which can be service using the apparatus show in FIG. 1.
Figure 2B:
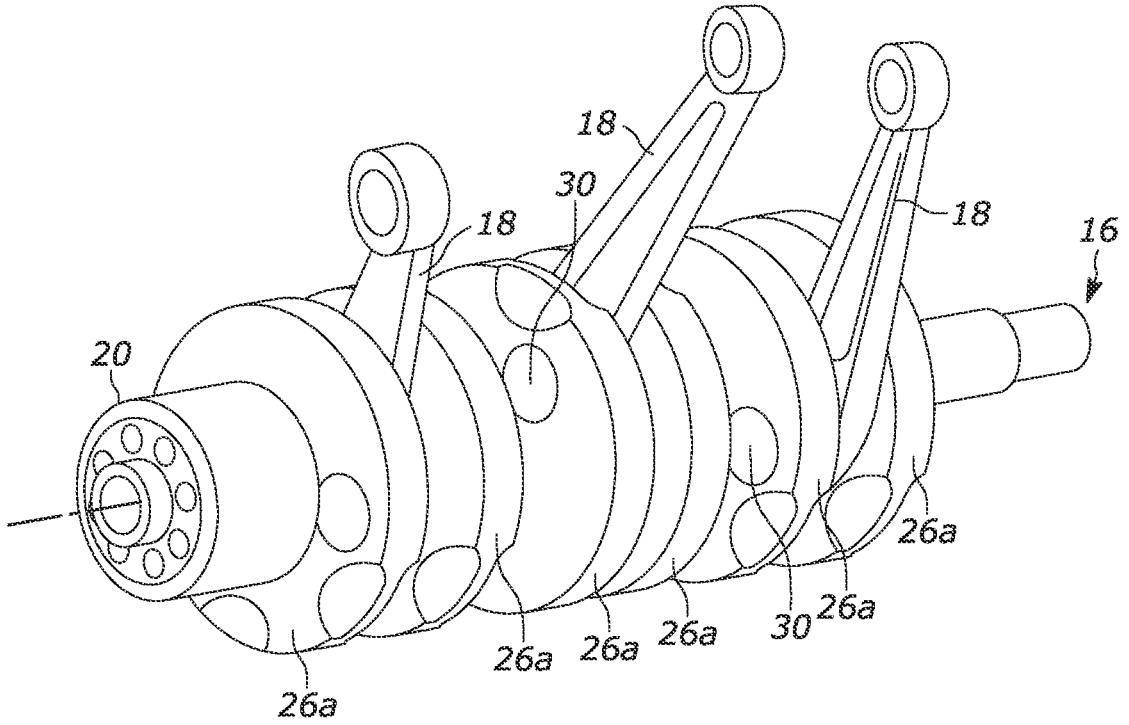
FIG. 2B is a perspective view of another example of a pressed-together crankshaft assembly.
Figure 2C:
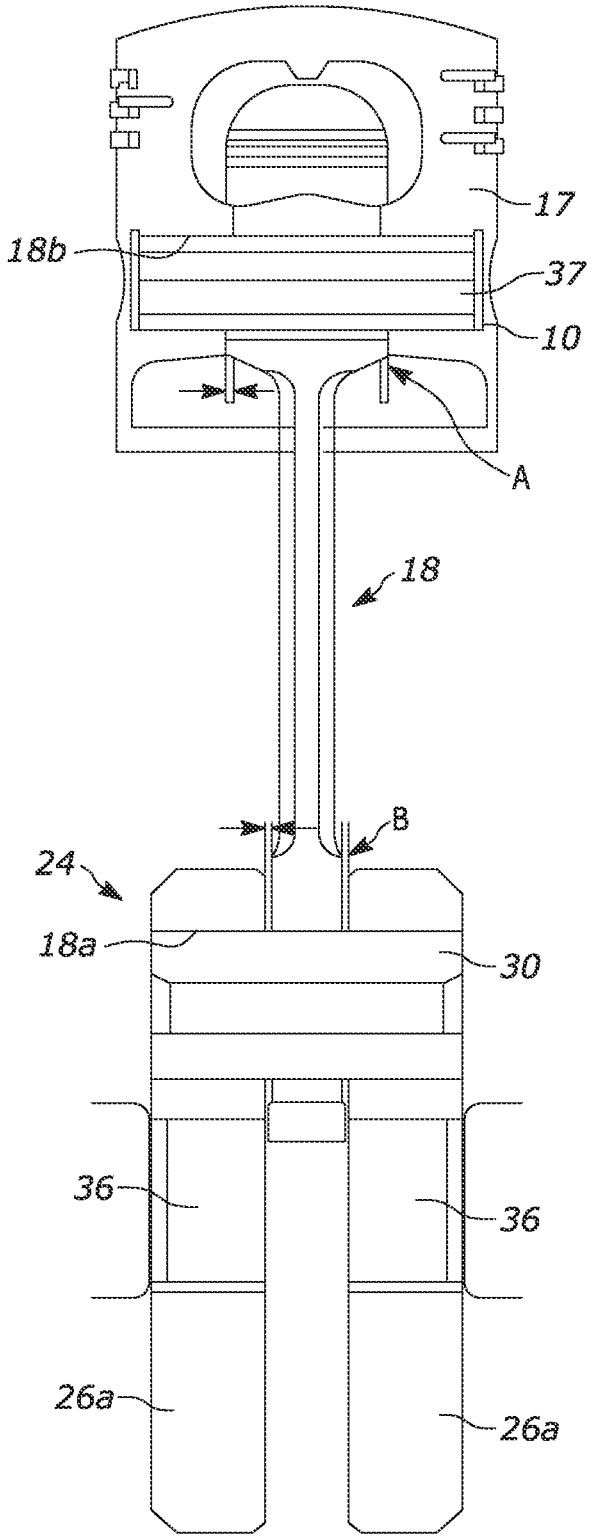
FIG. 2C is side view, partially in elevation, of a piston operatively connected to a crankshaft throw forming a part of the crankshaft shown in FIG. 2B.

FIG. 1 illustrates the overall construction of a tool or fixture 10 for use in the repair of a pressed together crankshaft. In particular, the disclosed tool or jig 10 facilitates the disassembly and reassembly of a pressed together crankshaft. FIGS. 2A-2C illustrate examples of crankshafts that the fixture shown in FIG. 1 can be used to repair and/or dissemble.

In particular, the crankshafts shown in FIGS. 2A and 2B are pressed together crankshafts that were used in two stroke Saab engines in the 1950's and early 1960's. By way of background, the crankshaft 16' shown in FIG. 2A was used in Saab 2 stroke "mixture" engines. This Saab engine includes three cylinders and the crankshaft 16' is rotatably supported in an engine block (not shown) by roller or ball bearings 20. The crankshaft is operatively coupled to three pistons 17 by associated connecting rods 18. The fuel for a "mixer" type 2 stroke engine comprises a mixture of oil and gasoline. These Saab engines are splash lubricated by oil entrained in the gasoline. These engines do not have an oil pump or a pump for circulating oil from an oil sump. In this type of engine the lubricating oil is consumed (burned) along with gasoline.

As seen in FIG. 2A, each connecting rod 18' is coupled to a crank throw 24 which was defined by a pair of crank plates 26 pressed onto either side of a rod pin 30. The crank plates 26 also define counterweight portions 26*a* for the crank throws 24. As seen in FIG. 2C, the lower portion of the connecting rod 18 is held to the crank throws 24 by the rod pin 30. It should be noted that the lower end of the connecting rod 18 (as seen in FIG. 2C) includes a needle bearing (not shown) located between the outside 30*a* of the rod pin 30 and the inside of the rod opening 18*a* through which the rod pin 30 extends. As seen in FIG. 2C, the crank plates 26*a* are pressed onto crankshafts stub shafts 36 which defined the rotational axis of the crankshaft. FIG. 2B illustrates the construction of a Saab two stroke crankshaft used on its "sport" model. The construction of the "sport" crankshaft is 16 similar to that shown for the mixer crankshaft in that the crank plates 26*a* are pressed onto a rod pin 30 and onto crankshaft stub shafts 36. However, in the "sport" crankshaft 16, the crank throws 24' are defined by a pair of circular crank plates 26 which also define counterweight portions 26*a*'. As seen best in FIG. 2A, the upper portions of the connecting rod (as viewed in FIG. 2A) are coupled to the associated piston 17 by a piston pin 37. A bearing, 39 such as a needle bearing is disposed between the upper rod opening 18*a* and the piston pin 37. As is also shown in FIG. 2A, the piston 17 included one or more conventional piston rings 17*a*.

FIG. 2C illustrates the assemble components of the piston and rod assembly. As indicated above, the piston 17 is rotatably connected to the associated piston rod 18 by a piston pin 37 which is locked in position by a lock ring 11. The lower end of the connecting rod 18 is rotatably connected to a crank pin 30 which, in turn, is pressed into a pair of crank plates 26*a*. As seen in FIG. 2C, clearance "A" is provided between the piston 17 and the upper end of the piston rod 18. A clearance "B" is provided between the lower end of the piston rod 18 and the crank plates 26*a*. The clearances "A" and "B" are shown on a Saab crank and are provided by the Saab crank manufacturer. It is believed that Saab provides a clearance "A" of approximately 0.005" and a clearance "B" of approximately 0.030". The clearance gaps "A" and "B" are designed to provide clearance for a flow of oil between the associated parts and to allow for slight misalignments between the piston 70 and the associated crank throw 24.

As should be apparent from the drawings, the crankshafts shown in FIGS. 2A and 2B are supported for rotation by a plurality of roller or ball bearings 20 and the piston rods 18 are operatively coupled to the crank throws 24 by associated bearings, such as needle bearings. When these types of crankshafts need rebuilding or repair, it generally involves the replacement of the crankshaft bearings 20 and/or the piston rod bearings. Replacement of these bearings require disassembly of the crankshaft and the replacement of rod pin 30 and the needle bearing between rod 18 and rod pin 30.

Figure 3:
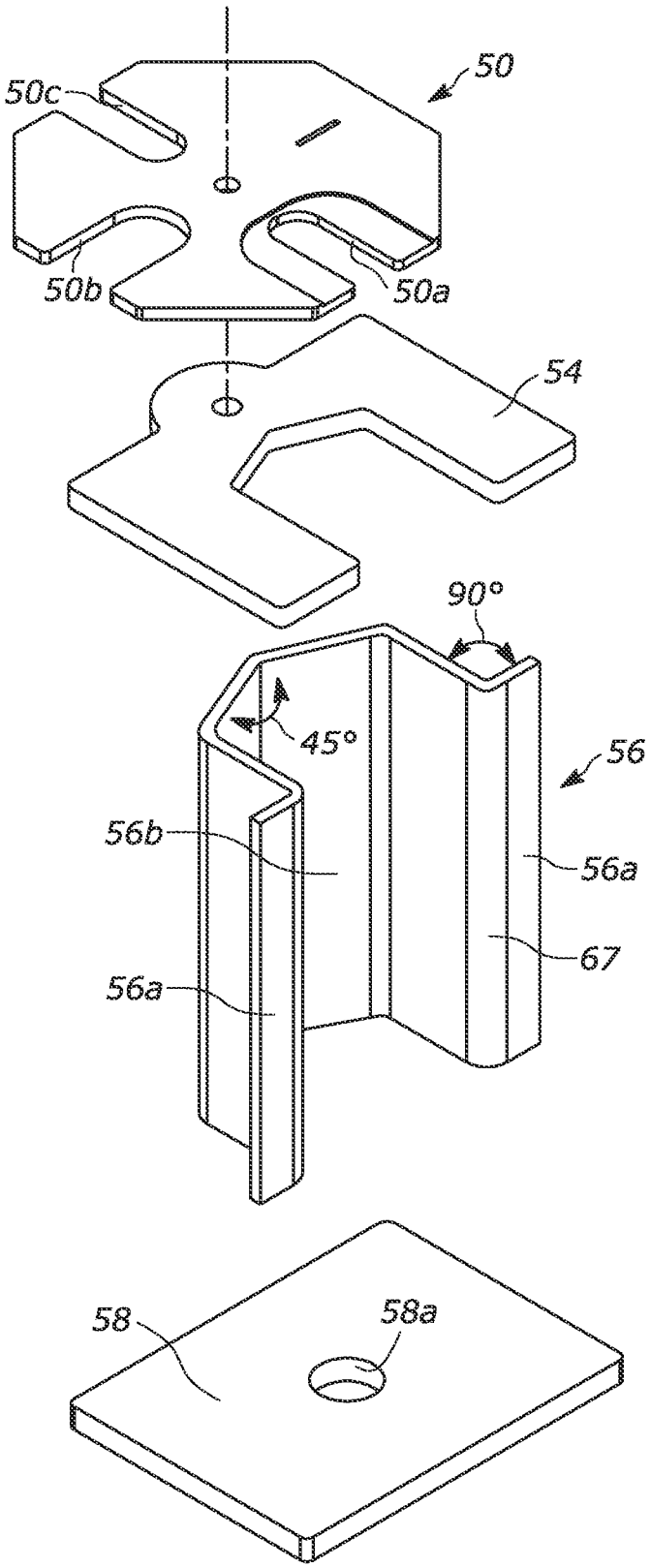
FIG. 3 is an exploded view of the apparatus or tool shown in FIG. 1.

FIG. 3 illustrates the components that comprise the tool or fixture 10 that facilitates disassembly of a pressed together crankshaft. The fixture comprises a rotatable crankshaft engagement or abutment plate 50 that is rotatably connected (by a bolt 53 shown in FIG. 4) to a fixed support plate 54 that sits atop a support column 56. The abutment plate 50 may also be termed a rotatable face plate or die plate. The support plate 54 is preferably welded to the column 56. The column 56, in turn, sits atop a base plate 58 and is also preferably welded there to. In the preferred and illustrated embodiment, the column 56 is a generally U-shaped channel that includes a pair of flanges 56*a* joined together by a web portion 56*b*. The flanges 56*a* may join the web 56*b* via gusset plates 67.

Figure 4:
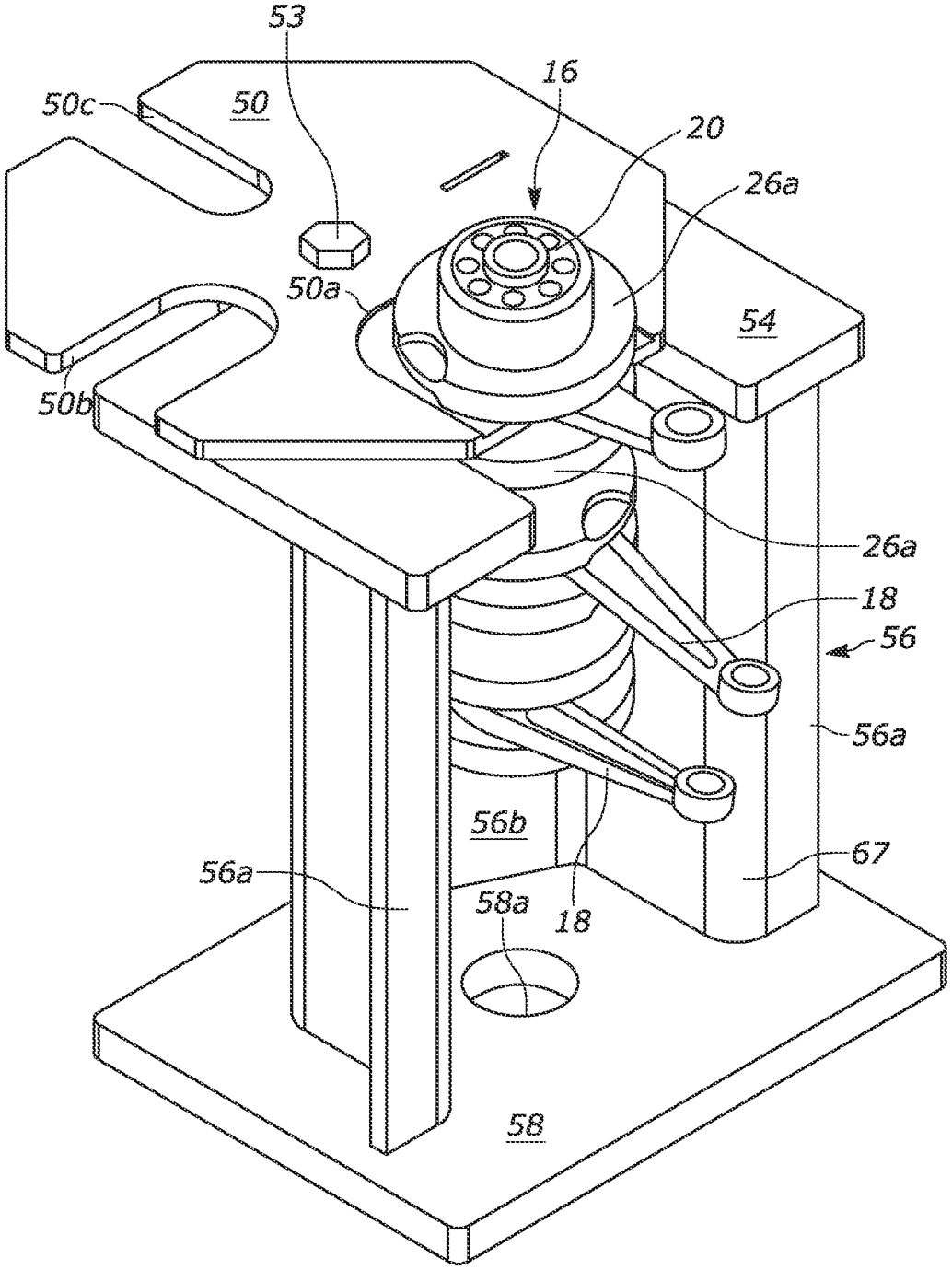
FIG. 4 is a perspective view showing the apparatus or tool of FIG. 1 engaging and supporting a crankshaft assembly that is to be disassembled.
Figure 5:
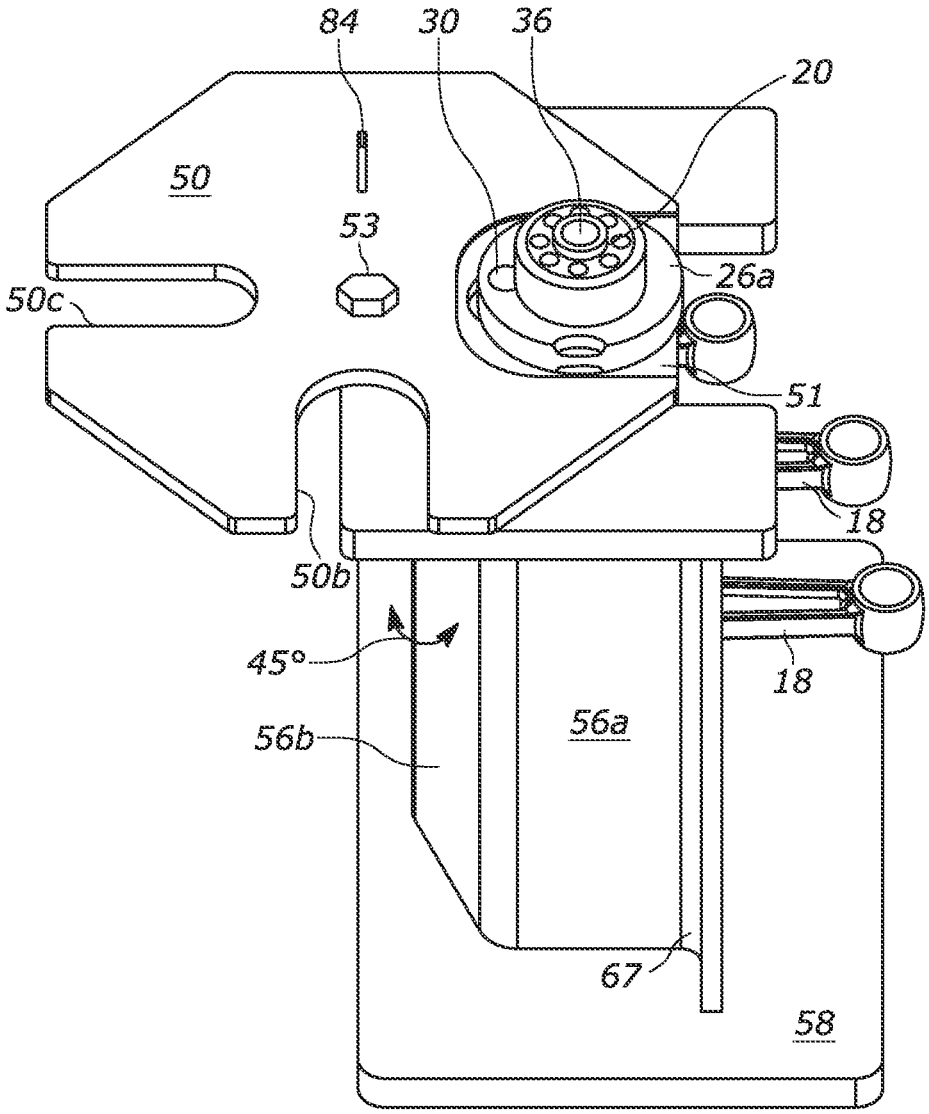
FIG. 5 is another perspective view showing the engagement and support of the crankshaft assembly by the tool prior to a pressing operation.
Figure 6:
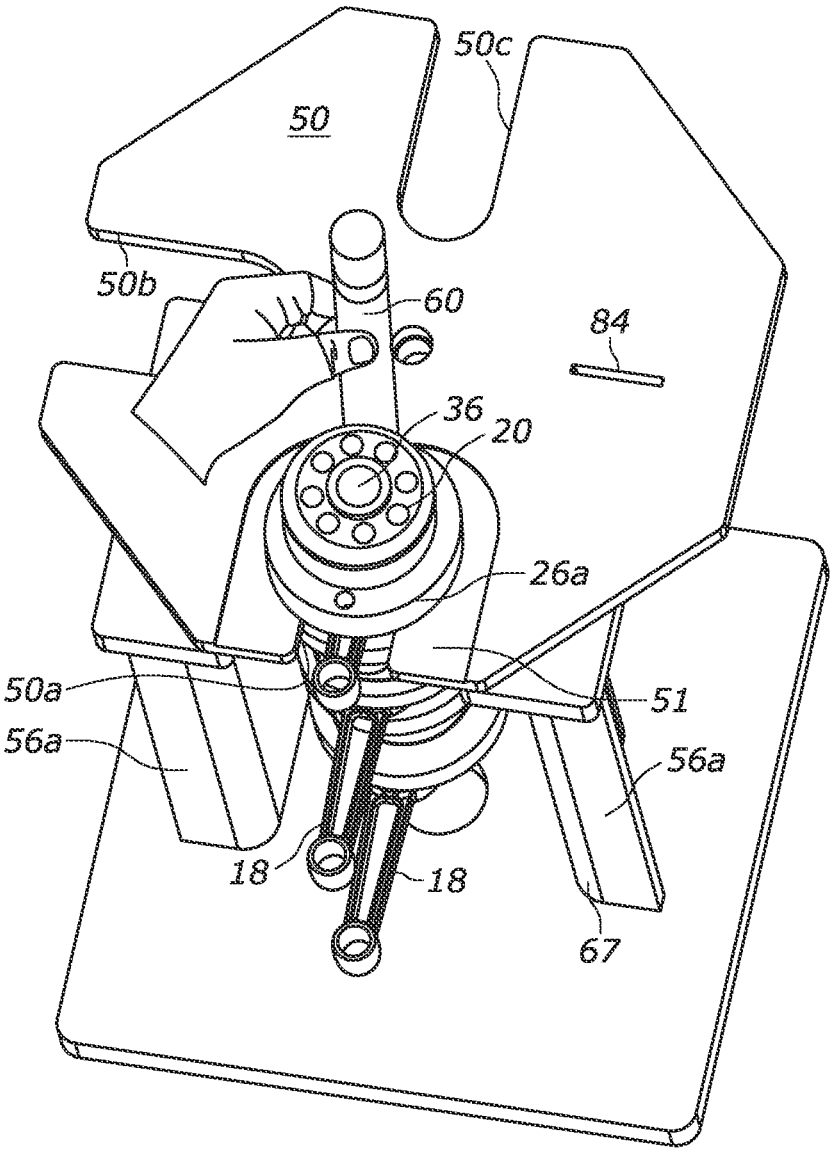
FIG. 6 is a perspective view showing the crankshaft assembly held by the tool and the application of separating forces to rod pin by a pressing implement.
Figure 7:
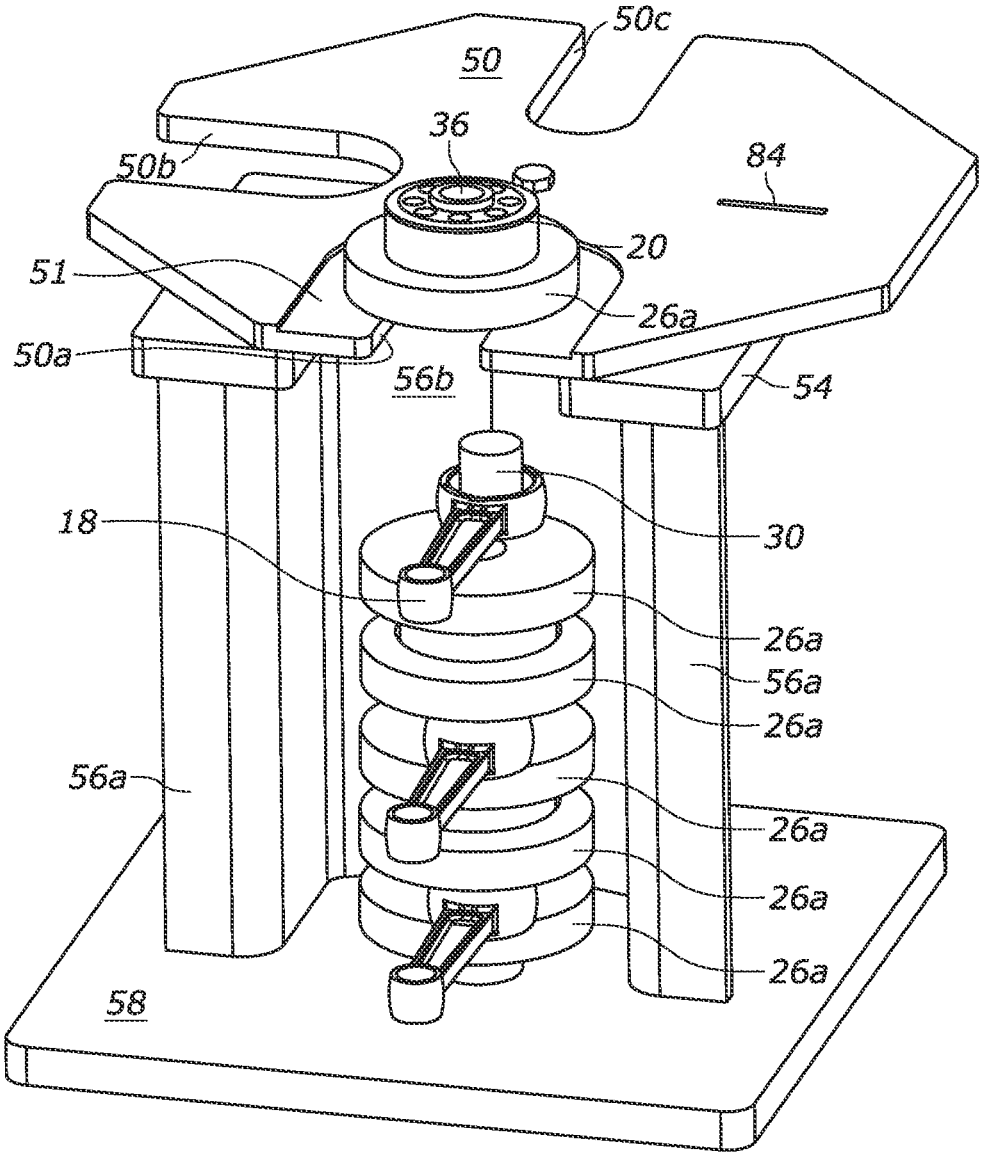
FIG. 7 shows the resulting separation of the crankshaft assembly that is achieved after the connecting rod pin is pressed from its associated component.
Figure 8:
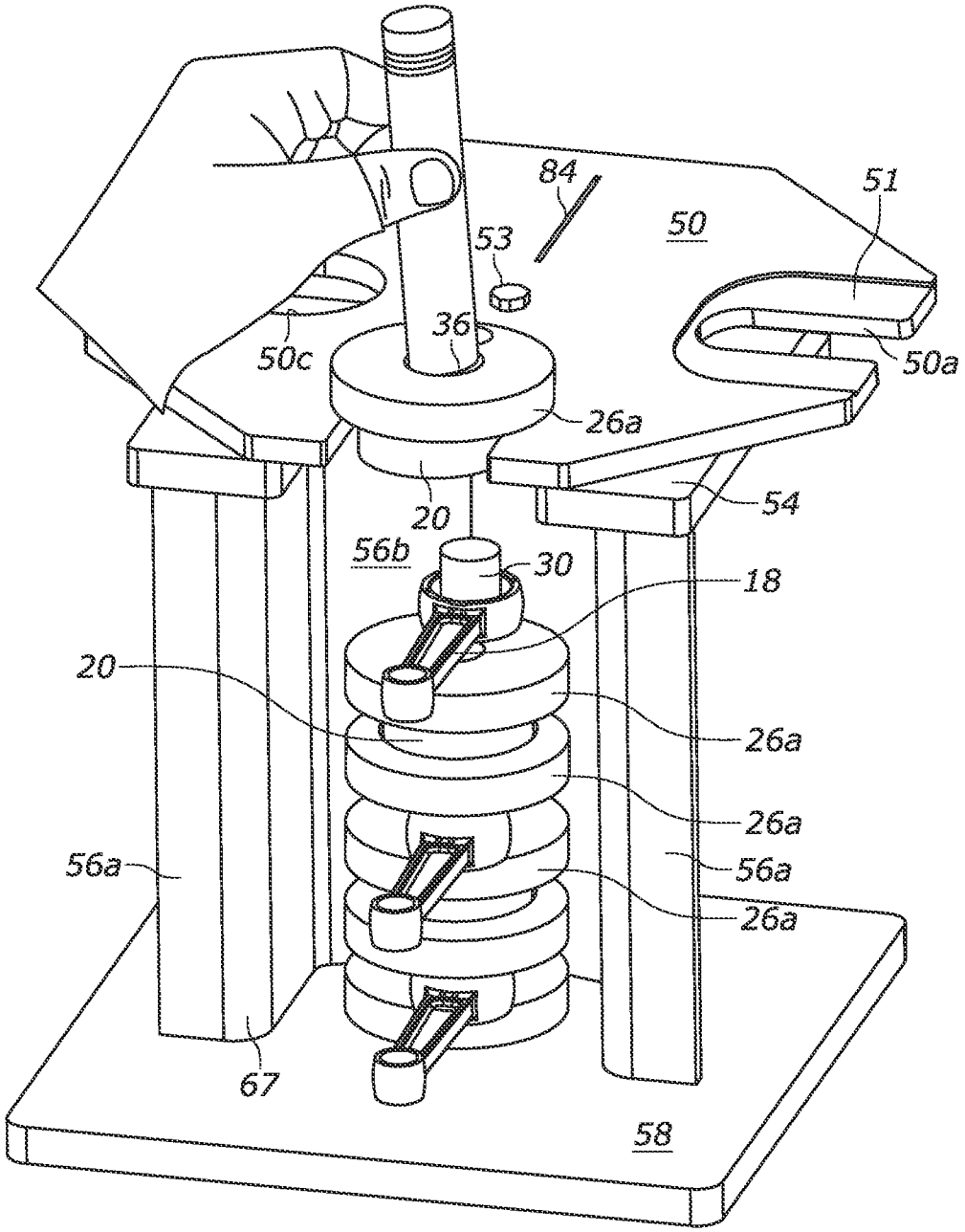
FIG. 8 is another perspective view showing the pressing of a crankshaft center shaft portion from crankshaft throw member.
Figure 9:
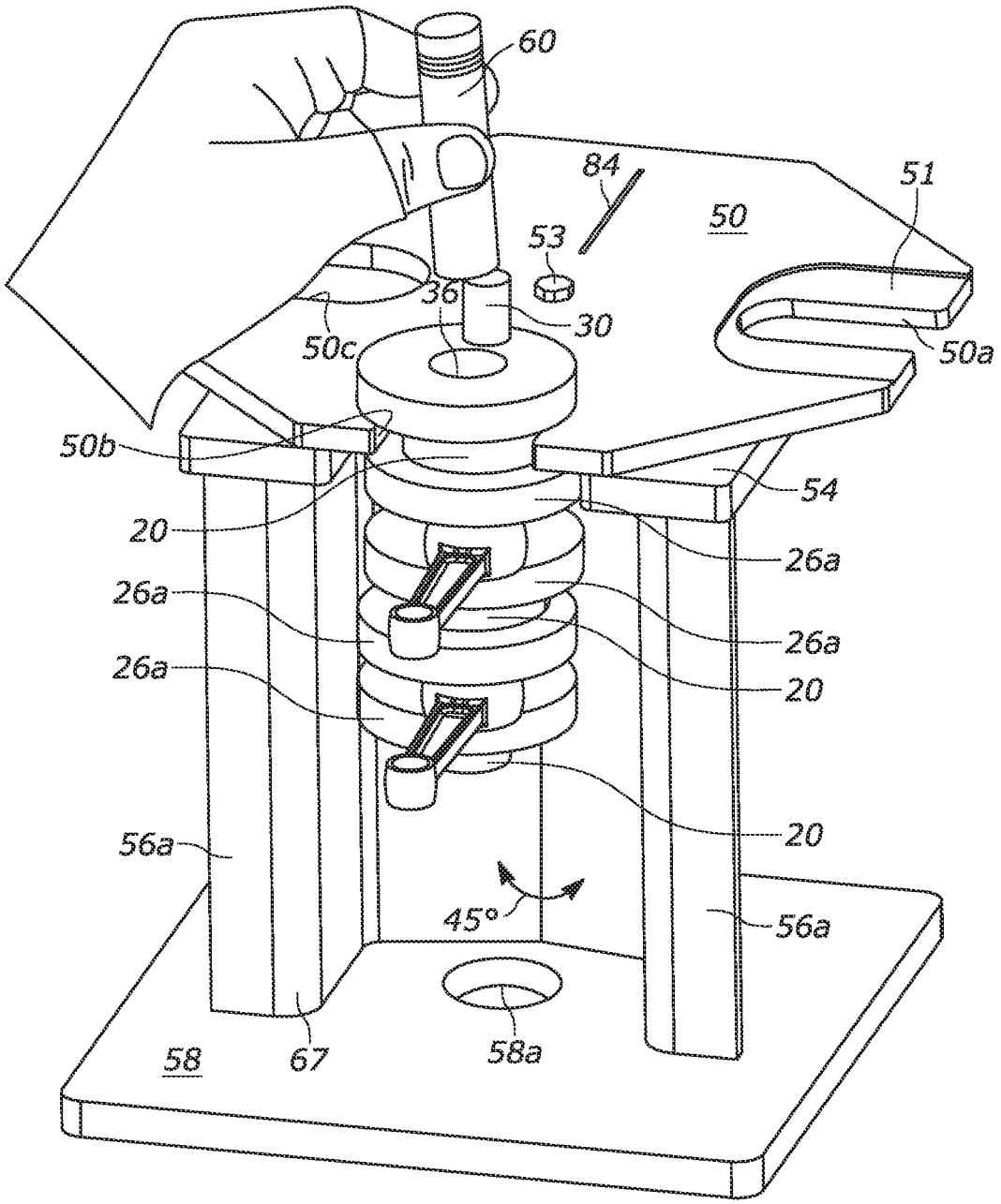
FIG. 9 is another perspective view of the crankshaft assembly remounted onto the crankshaft repair apparatus or fixture in preparation for pressing another crankshaft center shaft portion from another crankshaft throw member.
Figure 9A:
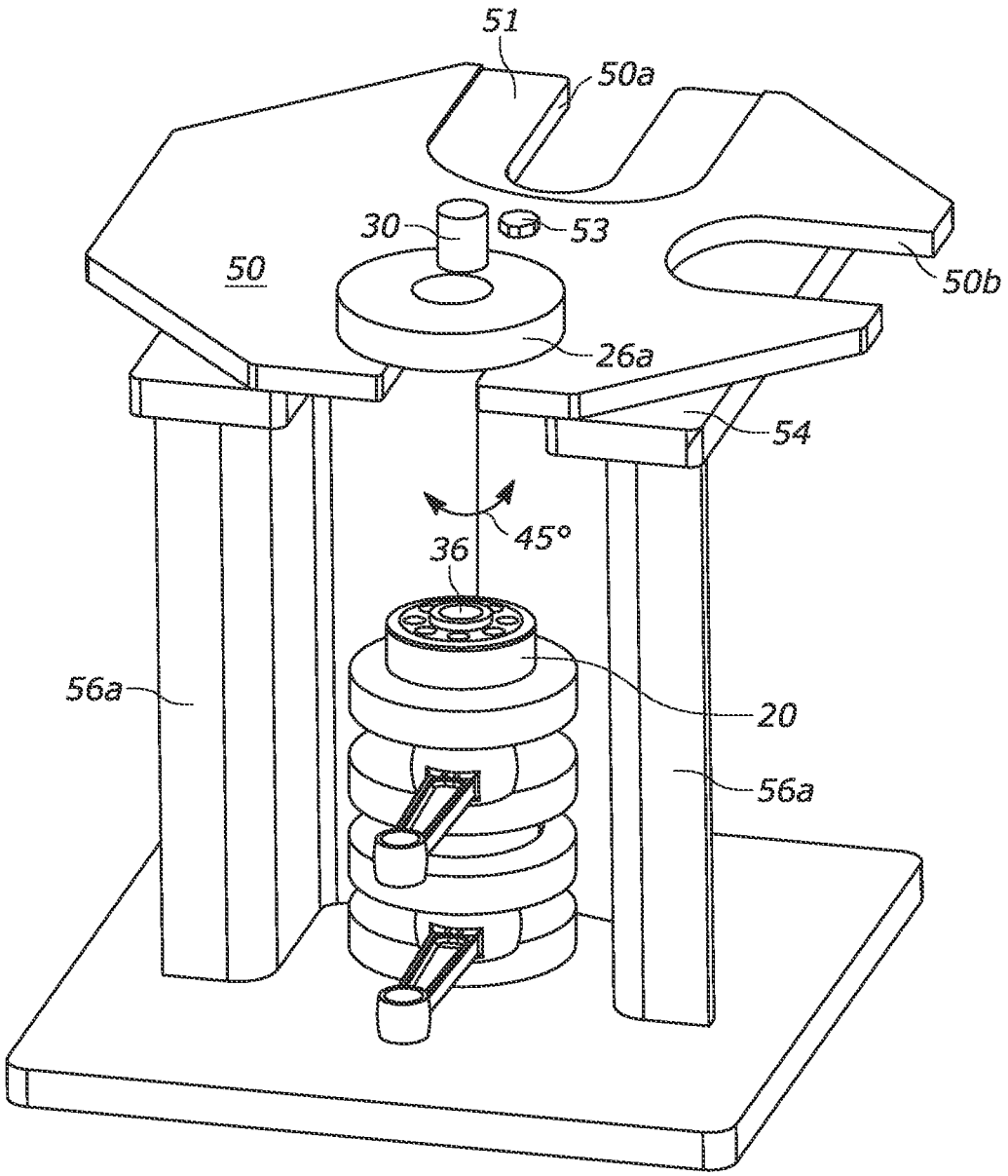
FIG. 9A is another perspective view which shows the result of the pressing step shown in FIG. 9.
Figure 10:
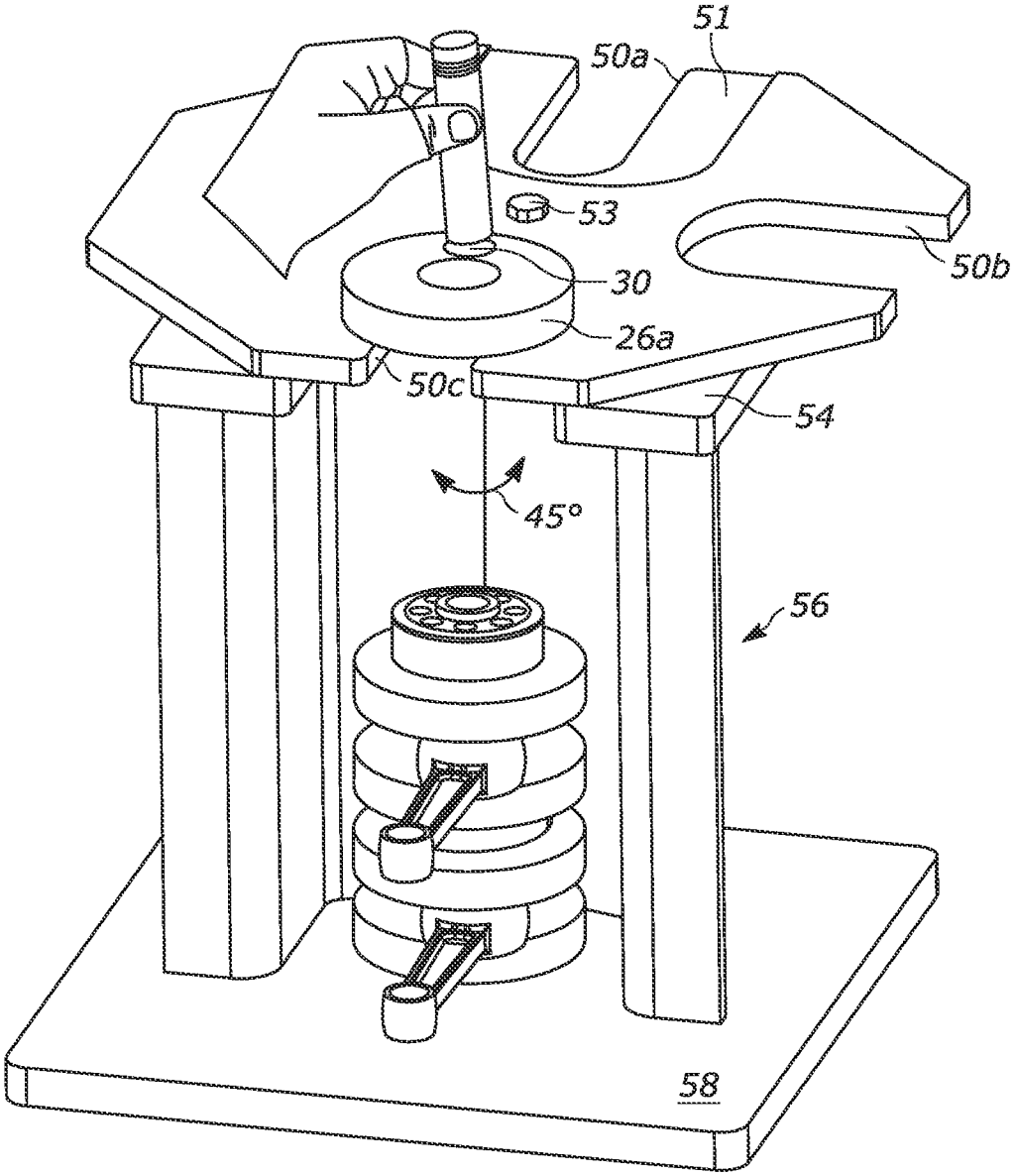
FIG. 10 is another perspective view showing another pressing step which illustrates how a rod pin is pressed from its associated component by a pressing implement.
Figure 11:
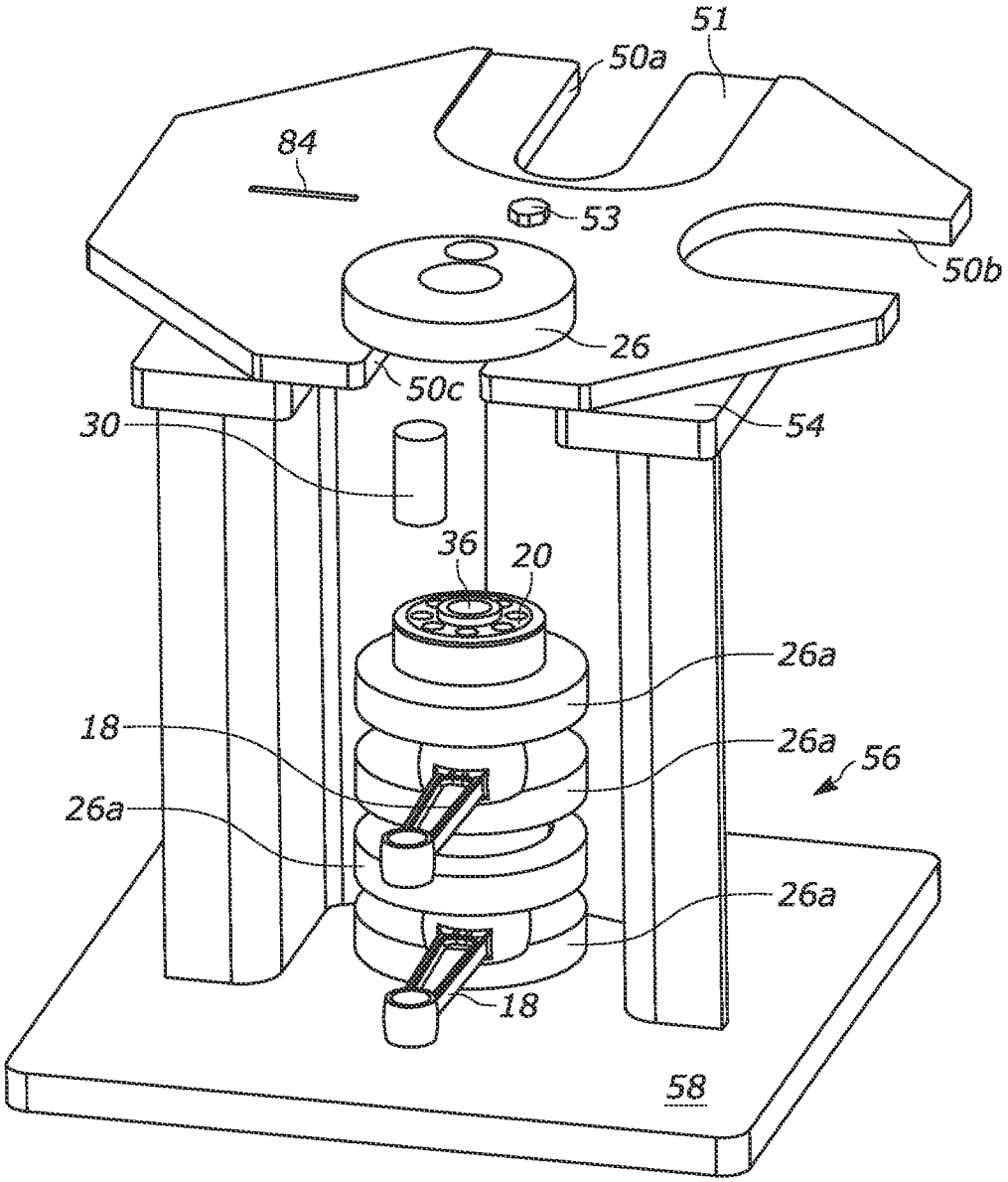
FIG. 11 shows the result of the pressing operation shown in FIG. 10.

In the preferred and illustrated embodiment, the crankshaft engagement or face plate 50 includes at least two slots 50*a*, 50*b*, one of which engages the crankshaft assembly 16 in the vicinity of the rod connection in order to press a rod pin 30 out of a crank plate 26*a* to enable separation of the crank plate 26*a* from the rest of the crankshaft assembly 16. The engagement plate 50 also includes the slot 50*b* sized to receive a center portion of the crankshaft assembly 16 to enable separation of a crank plate 26*a* from a center crank pin segment 36. FIGS. 4 and 5 illustrate a crankshaft assembly 16 held in a position that will enable a rod pin 30 (shown in FIG. 5) to be pressed downwardly to separate the rod pin 30 from its associated crank plate 26*a*. FIG. 6 illustrates the step of pressing the rod pin 30 using a suitable pressing implement 60. FIG. 5 shows the location of the rod pin 30 that is being pressed downwardly. FIG. 7 illustrates the resulting position of the crankshaft assembly 16 after the rod pin 30 is pressed out of the crank plate 26*a*. Following the operation illustrated in FIG. 7, the crank faceplate 50 is rotated to the slot 50*b* and the crank plate 26*a* with bearing 20 attached is turned over to the position shown in FIG. 8 and a center crankshaft segment 36 is pressed downwardly to separate the crankshaft segment 36 and bearing 20 from the crank throw plate 26*a*. After the crankshaft separation shown in FIG. 8 is accomplished, the rod 18 and associated rod bearing can be removed for repair and replacement and the remainder of the crankshaft assembly can be raised and inserted into the associated slot 50*b* and then an associated crankshaft segment (not shown) can be pressed from the crank plate 26*a* in order to separate the crank plate 26*a* from the rest of the crankshaft assembly as seen in FIG. 9. Following this operation, the rod pin 30 is pressed from the crank plate 26*a*. It should be apparent, the above described pressing operations and the repositioning of the crankshaft are repeated until the entire crankshaft is disassembled.

Once disassembled, the crankshaft center support bearings 20 and the rod bearings located in the crank throws 24 can be replaced. It should be noted here that the crankshaft throw 24 comprises individual crank plates 26*a* joined by a rod pin 30, Any other damaged components, i.e., spacers, oil slingers, etc. forming part of the crankshaft assembly can also be replaced. The disclosed repair fixture is then used to press together the crankshaft components to form a unitary crankshaft assembly which can be installed in an associated engine block (not shown).

It should be noted here, that in the illustrated embodiment, the rotatable crankshaft support plate or face plate 50 has a third slot 50*c*. See FIG. 4 and FIG. 5. The third slot can also be used to separate the crank plates 26*a* from an associated rod pin 30, if space permits. This third slot 50*c* could be used (if space permits) to provide increased support during the pressing operation or to support a crankshaft portion of a different configuration. The crankshaft engagement plate also includes an alignment slot 84 which facilitates alignment of the crankshaft components during reassembly.

The alignment slot 84 is shown in several of the drawings, such as FIGS. 8 and 9. The slot 84 is optional and is intended to facilitate alignment of the crankshaft components during the assembly process. For example, the slot 84 can be used to receive an alignment plate or tool, depending on the type of alignment desired. The tool may also be a tapered tool or member which the user may insert into the slot 84 in order to cause more precise alignment of the individual components prior to a pressing operation. It should be apparent that in order to obtain optimum performance of the two-stroke engine, the bearing throws 24 (which comprise joined together crank plates 26*a*) must be properly positioned with respect to a center line of the crankshaft. The size and configuration of the slot 84 is dependent upon the user's choice of alignment tooling, if alignment tooling is desired. Not all alignment tools need to utilize the slot 84, but it has been incorporated in the drawing to show a suggested placement of the slot 84. This slot is used as a centering slot when reassembly of the crankshaft is performed. Those skilled in the art can fabricate a suitable tool to fit in the slot 84 and in between the two crank plates (26*a*) that will align them while pressing them on to the rod pin (30).

It should also be noted here that the channel 56 which defines the support column may include a web 56*b* that is bent outwardly as seen in FIG. 1. In the preferred and illustrated embodiment, the web plate 56*b* is bent at an angle of substantially 45 degrees. With the configuration shown best in FIG. 3, additional clearance for the crankshaft assembly is provided during the pressing operations. However, depending on the crankshaft configuration and size, a planar web portion 56*b* may be suitable.

It should be noted here that the illustrated apparatus for disassembling and reassembling individual components of the crankshaft are shown in a configuration that facilitates the disassembly and assembly of a Saab two-stroke crankshaft. It should also be noted that the crankshaft engagement plate 50 and associated slot and slot dimensions may vary depending on the type of two-stroke crankshaft that is intended to be serviced by the apparatus. As indicated above, the apparatus shown in the drawings is intended to service two-stroke Saab crankshafts. In particular, for a Saab two-stroke crankshaft, the crankshaft engagement or die plate 50 is configured as follows. Plate 50 includes at least two pressing slots (or positions) 50*a* and 50*b*. As indicated above, the slot 50*a* is used to separate a crank plate 26*a* from the rod pin 30. In the preferred embodiment, the slot 50*a* includes a reduced thickness area 51 that surrounds the slot. This reduced thickness slot is intended to be used where clearance is reduced. In the illustrated embodiment, the overall rotatable die plate 50 has a nominal thickness of 0.5". However, to provide more clearance during pressing operations, the area 51 surrounding the slot 50 may have a reduced thickness of 0.400". As indicated above, the illustrated apparatus is intended to separate crank plates on both a standard crankshaft shown in FIG. 2A and a sport crankshaft shown in FIG. 2B. For Saab or other crankshafts that do not need the reduced thickness area, the slot 50C can be used. In the illustrated embodiment, the Saab slot 50*a* has a nominal thickness of 0.500".

It should also be noted here, that in the illustrated embodiment, the areas of face plate that are used to separate the crank plates 26A from the associated rod bearing 30 have a nominal width of 2". The slot area for the slot areas 50*b* has nominal width of 3". In the illustrated embodiments, the widths of the rod pressing areas 50*a* and 50*c* are about 2". The main bearing press area is approximately 3". In the illustrated embodiment, the alignment slot 84 is approximately 0.200" wide and 2" long.

It should be noted here, that the die or face plate 50 is changeable depending on the configuration of the crankshaft being worked on. The above specified dimensions are intended to work with two-stroke Saab crankshafts. However, other crankshafts that require disassembly and reassembly may require different configurations for the face plate or die plate 50. As should be apparent, the plate 50 includes the properly dimensioned bore which receives the locking bolt 53 in order to change the face plate 50 for a pressed together crankshaft having a configuration different from that of Saab two-stroke crankshaft.

It should also be noted here that, in the illustrated embodiment, the channel width 56*b* is bent outwardly by 45°. Again, this dimension is suitable for a Saab two-stroke crankshaft. Crankshafts of other manufacturers may require a different angle in order to accommodate the configuration of the crankshaft. It should also be noted here, that for some applications, the dimensions of the flanges 56*a* may be altered and configured differently in order to provide clearance for the crankshaft assembly portion hanging from the die or face plate 50.

It also should be noted that the invention contemplates a tool or fixture that is oriented transversely to the position shown in FIG. 1. Additionally, the crankshaft receiving slots 50*a*, 50*b*, 50*c* are shown as being spaced 90° apart with respect to each other. This is preferred but other rotated spacings are contemplated.

Although the invention has been described with a certain degree of particularity, it should be noted that various changes can be made to it without departing from the spirit or scope of the invention as hereinafter claimed.

What is claimed is:

1. Apparatus for facilitating the disassembling and assembling a pressed-together crankshaft assembly;

(a a crankshaft engagement member having a first slot for receiving and supporting a crankshaft throw while a rod pin is pressed out of its associated throw member;

b) a second slot in said crankshaft engagement member for supporting a crankshaft assembly as a crankshaft center member is pressed from its operative position to enable the removal of crankshaft center bearing from the crankshaft assembly;

c) said crankshaft engagement member rotatably attached to a channel member that includes a fixed support plate which supports the crankshaft during a pressing operation;

d) the channel member including a pair of spaced apart flanges joined together by a web portion, said flanges and web portion being configured to provide a space for receiving a crankshaft portion located below said crankshaft engagement member.

2. The apparatus of claim 1 wherein said first slot and said second slot located on said crankshaft engagement plate are spaced substantially 90° apart.

3. The apparatus of claim 2 wherein said crankshaft engagement plate includes another slot for receiving a crankshaft throw portion being a different configuration.

4. The apparatus of claim 2 wherein said fixture includes a base plate having an opening for receiving a portion of the crankshaft when said crankshaft is not engaged by said engagement member.

5. The apparatus of claim 3 where the first, second and third slots are moved into operative positions by rotating said crankshaft engagement member.

6. The apparatus of claim 1, wherein said first slot includes a reduced thickness along its inside periphery to enable a crankshaft throw having reduced clearance to be received by said slot.

7. The apparatus of claim 1, wherein said channel comprises a pair of flanges joined together by a web portion, said web portion being bent outwardly to provide clearance for a crankshaft assembly portion hanging below said crankshaft engagement member.

8. The apparatus of claim 1, wherein said first and second slots are configured to receive throw members and crankshaft center portions on a crank assembly used in Saab two stroke engines.

9. The apparatus of claim 1, wherein said rod pin of said crankshaft assembly is pressed from its operative position by a hydraulic press using an implement for applying pressure from said hydraulic press to an end face of said rod pin.

10. The apparatus of claim 1 wherein said throw member is defined by a pair of spaced apart crank plates which each define a counterweight portion, said spaced apart crank plates being pressed onto opposite ends of said rod pin.

11. An apparatus for facilitating the disassembling and assembling of a pressed together crankshaft assembly:

a) a column structure comprising a base plate for supporting the structure, said structure comprising a channel member extending between the base plate and a fixed support plate;

b) said fixed support plate supporting a rotatable crankshaft engagement plate that includes at least one slot for receiving a throw section of said crankshaft assembly to enable crank plates on said throw section to be removed from a crankshaft rod pin to which said crank plates are fixedly attached;

c) another slot in said crankshaft engagement plate being dimensioned to receive a center section of said crankshaft assembly, whereby center crank pins for said assembly can be separated from said crank plates when a suitable force is applied.

12. The apparatus of claim 11 wherein said crankshaft assembly engagement plate has a third slot defined in said plate whereby portions of a crankshaft having increased clearance can be used to separate crank plates from an associate rod pin to which the crank plates are pressed fitted.

13. The apparatus of claim 11 wherein said crankshaft assembly is reassembled by reversing the pressing operations set forth in claim 12.

* * * * *